US007248156B2

(12) United States Patent
Wisniewski et al.

(10) Patent No.: US 7,248,156 B2
(45) Date of Patent: Jul. 24, 2007

(54) COMBINATION AIRBORNE SUBSTANCE DETECTOR

(75) Inventors: Jeffrey T. Wisniewski, Ingleside, IL (US); Thomas H. Wisniewski, Ingleside, IL (US); Karl T. Olinger, Oostburg, WI (US)

(73) Assignee: MTI Industries, Inc., Volo, IL (US)

( * ) Notice: Subject to any disclaimer, the term of this patent is extended or adjusted under 35 U.S.C. 154(b) by 187 days.

(21) Appl. No.: 10/981,904

(22) Filed: Nov. 4, 2004

(65) Prior Publication Data

US 2006/0103521 A1 May 18, 2006

(51) Int. Cl.
*G08B 23/00* (2006.01)

(52) U.S. Cl. ..... 340/517; 340/628

(58) Field of Classification Search ..... 340/517, 340/521, 522, 525, 511, 514, 627, 628, 691.1
See application file for complete search history.

(56) References Cited

U.S. PATENT DOCUMENTS 5,557,262 A * 9/1996 Tice ..... 340/587
5,691,703 A * 11/1997 Roby et al. ..... 340/628
5,801,633 A * 9/1998 Soni ..... 340/628
5,969,604 A * 10/1999 Tice ..... 340/506
6,897,774 B2 * 5/2005 Costa et al. ..... 340/522
6,967,582 B2 * 11/2005 Tice et al. ..... 340/630

* cited by examiner

*Primary Examiner*—John Tweel, Jr.
(74) *Attorney, Agent, or Firm*—McAndrews, Held & Malloy, Ltd.

(57) ABSTRACT

A combination airborne substance detection apparatus includes an enclosure, a first module disposed within the enclosure for detecting the presence of a quantity of a first airborne substance, a second module disposed within the enclosure for detecting the presence of a quantity of a second airborne substance, and an alarm module for producing a first perceivable emission when the first substance is detected and for producing a second perceivable emission when the second substance is detected. The first perceivable emission includes at least one of an audible and a visible emission that is distinguishable from the second perceivable emission. The first and second detector modules are each capable of independently and continuously detecting the first and second substances, respectively.

12 Claims, 5 Drawing Sheets

DECISION BOX DECIDER:

1) IF A STATE IS TOGGLED
2) IF B STATE IS TOGGLED
3) IF A & B STATES ARE TOGGLED

LOGIC OF A AND B OUTPUTS

| A | B | ALARM |
|---|---|---|
| 1 | 0 | A |
| 0 | 1 | B |
| 1 | 1 | A & B |

COMBINATION AIRBORNE SUBSTANCE DETECTOR

FIELD OF THE INVENTION

The present invention relates to an apparatus for detecting a combination of airborne substances. More particularly, the present invention relates to an apparatus for the detection of a plurality of substances, such as carbon monoxide gas and propane, where a warning is given when one or more substances is detected. Independent detection and warning continue for remaining non-detected substances, if any.

BACKGROUND OF THE INVENTION

Common types of airborne substance detectors include smoke and carbon monoxide detectors. Such devices are typically configured as single detector units that sound an alarm upon detection of a single target substance. Combination airborne substance detectors, by contrast, are capable of sensing, within the same device, the presence of a plurality of target substances.

Combination airborne substance detectors are useful because they provide an efficient means for detecting and warning of the presence of potentially hazardous and/or harmful target substances. For instance, when detecting for a plurality of airborne substances, the use of more than one substance detector is undesirable in that multiple detectors does not allow for optimal placement near potential source(s) of target substances, requires additional power sources or connections, imposes additional space requirements, and can be visually unappealing.

In typical combination detector systems, the detection of one substance has priority over the remaining secondary substance(s). The detection of secondary substances is disabled in typical combination detector systems once the primary substance is detected. The theory of operation in these typical combination detectors is that detection of the primary substance has priority that negates further detection of remaining target substance(s).

A problem associated with typical combination airborne substance detectors is the user is no longer warned of the presence of secondary substances once the primary substance is detected. For airborne substances such as smoke, carbon monoxide or combustible gases, a life-threatening condition can occur for which no warning is given. For instance, in typical combination smoke-carbon monoxide detectors, smoke detection has precedence over carbon monoxide detection. But, in a combination combustible gas-carbon monoxide detector, carbon monoxide detection may have priority over combustible gas detection, thereby potentially endangering a user's health and/or safety. A combustible gas leak, such as a propane leak, requires the user to take immediate action, whereas excess carbon monoxide generally means the user has time to react. If carbon monoxide is detected causing the alarm to emit a warning, and there is further a propane leak, the user will be unaware of the dangerous second condition. For example, in reacting to a carbon monoxide alert, the user may activate an electrical device, such as a fan or light, which could in turn lead to ignition of a combustible gas that is also present in the nearby environment.

A combination airborne substance detector, as disclosed herein, provides advantages over conventional devices by its capability to simultaneously alert a user of multiple life-threatening conditions. Furthermore, in environments where combustible gas(es) and/or other critical conditions involving potentially hazardous airborne substances are present, and for which immediate attention and remedial action is required or desirable, the present combination airborne substance detector provides the additional advantage of being able to initially warn of such critical conditions, followed by warnings of any secondary critical conditions.

SUMMARY OF THE INVENTION

A combination airborne substance detection apparatus provides one or more of the above advantages, and/or overcomes one or more of the above shortcomings. In a first embodiment, the detector comprises:

(a) an enclosure;

(b) a first module disposed within the enclosure for detecting the presence of a quantity of a first airborne substance;

(c) a second module disposed within the enclosure for detecting the presence of a quantity of a second airborne substance; and (d) an alarm module for producing a first perceivable emission when the first substance is detected and for producing a second perceivable emission when the second substance is detected, the first perceivable emission comprising at least one of an audible and a visible emission that is distinguishable from the second perceivable emission.

The first and second detector modules are each capable of independently and continuously detecting the first and second substances, respectively.

In a preferred first embodiment, the first module and second module constitute a single module capable of sensing a plurality of airborne substances.

In another preferred first embodiment, the first emission is implemented first followed by implementation of the second emission when the first and second substances are at least one of simultaneously or near simultaneously detected.

In another preferred first embodiment, the first and second airborne substances are each selected from the group consisting of smoke, propane, carbon monoxide, methane, butane, mercury, ethylene oxide, volatile organic compounds, hydrogen sulfide, hydrogen, ammonia, combustible gases, cholorfluorocarbons, toxic gases, and optically-detectable gases, and the first substance and the second substance are different group members.

In another preferred first embodiment, the first and second airborne substances are each selected from the group consisting of carbon monoxide and a combustible gas, and the first substance and the second substance are different group members.

In another preferred first embodiment, the quantity of at least one of the first and second airborne substances is recorded at predetermined intervals from at least one of the first and second modules, respectively.

In a second embodiment, a combination airborne substance detection apparatus comprises:

(a) an enclosure having at least one opening;

(b) a circuit board disposed within the enclosure;

(c) a first electronic sensing device connected to the circuit board, the sensing device located near the at least one opening, the sensing device capable of continuously and independently detecting the presence of a quantity of a first airborne substance;

(d) a second electronic sensing device connected to the circuit board, the sensing device located near the at least one opening, the sensing device capable of continuously and independently detecting the presence of a quantity of a second airborne substance; and (e) an alarm module for producing a first perceivable emission when the first substance is detected and for producing a second perceivable emission when the second substance is detected, the first perceivable emission comprising at least one of an audible and a visible emission that is distinguishable from the second perceivable emission, wherein the first and second emissions are capable of occurring independently of each other.

Preferred aspects of the second combination detector embodiment defined have the same or similar features as those defined above for the first combination detector embodiment.

In one embodiment, a method of monitoring concentrations of airborne substances comprises:

continuously detecting the presence of a quantity of a critical airborne substance;

continuously detecting the presence of a quantity of a secondary airborne substance; and implementing at least one of a first perceivable emission when the critical substance is detected and a second perceivable emission when the secondary substance is detected, where the first perceivable emission is distinguishable from the second perceivable emission.

The first emission is implemented first followed by implementation of the second emission when the critical and secondary substances are at least one of simultaneously and near simultaneously detected.

In a preferred embodiment of the foregoing method, the first and second airborne substances are each selected from the group consisting of smoke, propane, carbon monoxide, methane, butane, mercury, ethylene oxide, volatile organic compounds, hydrogen sulfide, hydrogen, ammonia, combustible gases, chlorofluorocarbons, toxic gases, and optically-detectable gases, and the first substance and the second substance are different group members.

In another preferred embodiment of the foregoing method, the first and second airborne substances are each selected from the group consisting of carbon monoxide and a combustible gas; and the first substance and the second substance are different group members.

In another preferred embodiment of the foregoing method, the quantity of at least one of the first and second airborne substances is recorded at predetermined intervals.

DETAILED DESCRIPTION OF PREFERRED EMBODIMENT(S)

Figure 1:
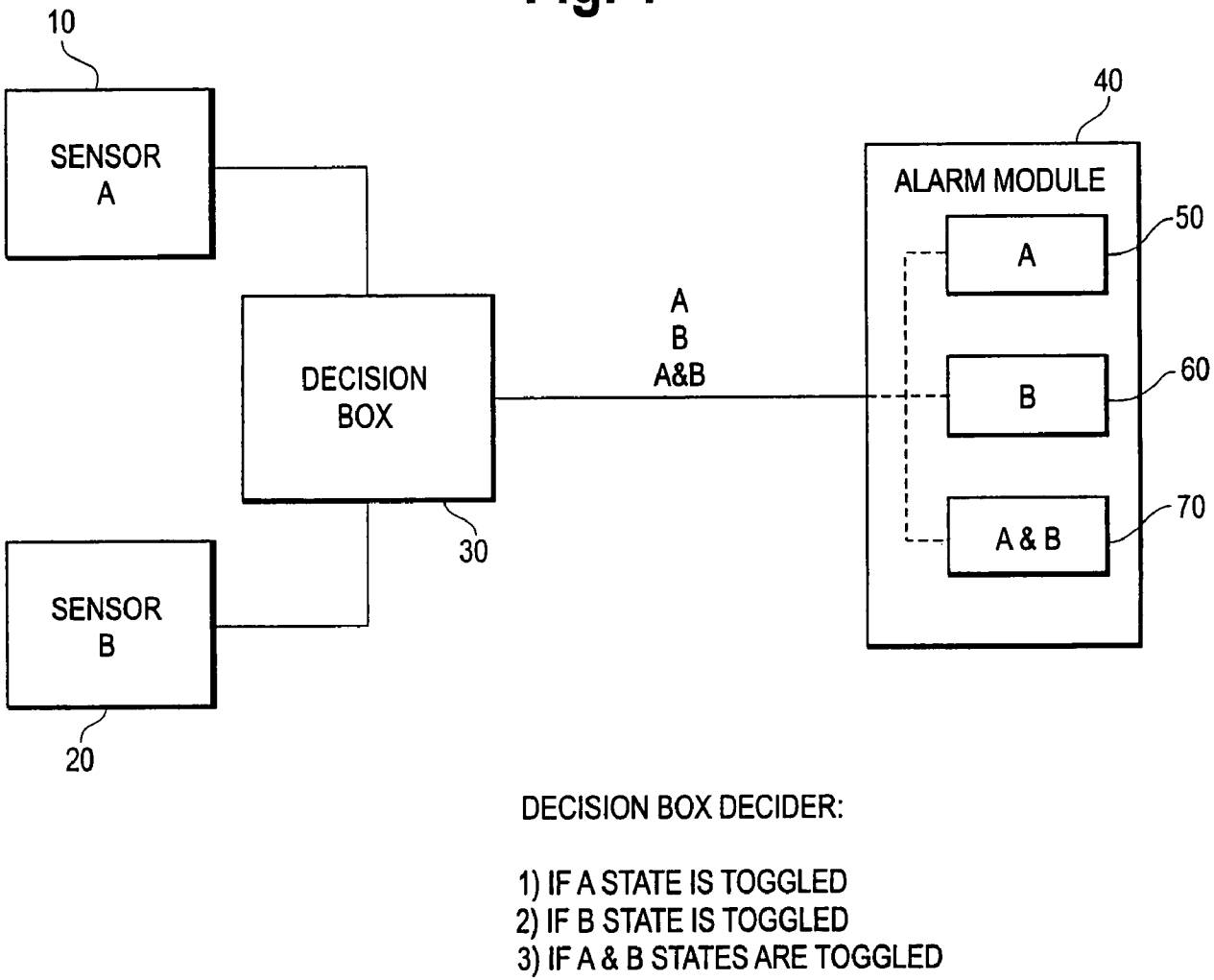
FIG. 1 is a functional diagram of an embodiment of the present combination airborne substance detector apparatus.

FIG. 1 illustrates a functional diagram of an embodiment of the present airborne substance detector apparatus. A first module 10 can be a sensing device for a first airborne substance. A second module 20 can be a sensing device for a second airborne substance, different from that being sensed by the first module 10. The first and second modules 10, 20 electronically communicate with a decision box 30. The decision box 30 continuously and independently communicates with the first and second modules 10, 20 monitoring for signal fluctuations indicative of the presence of target airborne substances. Continuous monitoring of the decision box 30 can include checking for signal input fluctuations on an intermittent basis in periods of approximately every few seconds. Additional modules may electronically communicate with the decision box 30 for detecting additional conditions. The first module 10, second module 20, and additional modules, if any, can also constitute (that is, form part of) a single module 100 (see FIG. 2) for sensing multiple airborne substances. The single module 100 also electronically communicates with the decision box 30.

The first module 10 and second module 20 can contain sensors of the metal oxide type including tin, which detect airborne substances through changes in electrical conductivity. Other types of sensors can be contained within the modules to provide similar sensing capabilities, including but not limited to, infrared or other optical-type sensors.

Recordings can be made at predetermined intervals of a quantity of the first and/or second airborne substances. The recordings can be made electronically, either within the first or second modules 10, 20, outside the modules 10, 20 in separate memory devices, or in the decision box 30. The recording is made of the resistance, conductivity, or other relevant electrical parameter and is correlated to an appropriate concentration for the target substance via a fixed constant or correlation curve.

The types of airborne substances that can be detected by the first module 10, second module 20, or additional modules, if any, include smoke, carbon monoxide, propane, methane, butane, mercury, ethylene oxide, ammonia, volatile organic compounds, hydrogen sulfide, hydrogen and other combustible gases, chlorofluorocarbons (such as, for example, duPont Freon® and similar refrigerants), other toxic gases, and optically-detectable gases.

When an input signal fluctuation is received by the decision box 30 from the first module 10, the decision box 30 electronically communicates an output signal to an alarm module 40 to produce a first perceivable emission in a corresponding first alarm 50. When an input signal fluctuation is received by the decision box 30 from the second module 20, the decision box 30 electronically communicates an output signal to the alarm module 40 producing a second perceivable emission either through the same first alarm 50 or through a separate second alarm 60.

When an input signal fluctuation is simultaneously or near simultaneously received by the decision box 30 from both the first and second modules 10, 20, the decision box 30 electronically communicates an output signal to the alarm module 40 to produce a perceivable emission. The perceivable emission warns for the conditions sensed by both the first and second modules 10, 20. The perceivable emissions will be distinct from each other so that the user is warned of both conditions. Furthermore, the emission alerting for the primary target substance can be more prominent relative to the secondary target substance(s). The perceivable emission(s) may occur through the first alarm 50, the second alarm 60, or a third alarm 70.

The first and second perceivable emissions can include the types of emissions detectable or perceivable by the human senses. Typical perceivable emissions include audible and/or visible emissions. The alarm module 40 can be a self-contained unit containing devices for producing perceivable emissions as directed by the decision box 30. It can also consist of multiple units, each unit producing its own perceivable emission, as directed by the decision box 30.

The modules 10, 20, decision box 30, and alarm module 40 can be disposed within an enclosure. The enclosure is typically shaped as a rectangular box or disc-like structure and typically constructed of plastic material.

Figure 2:
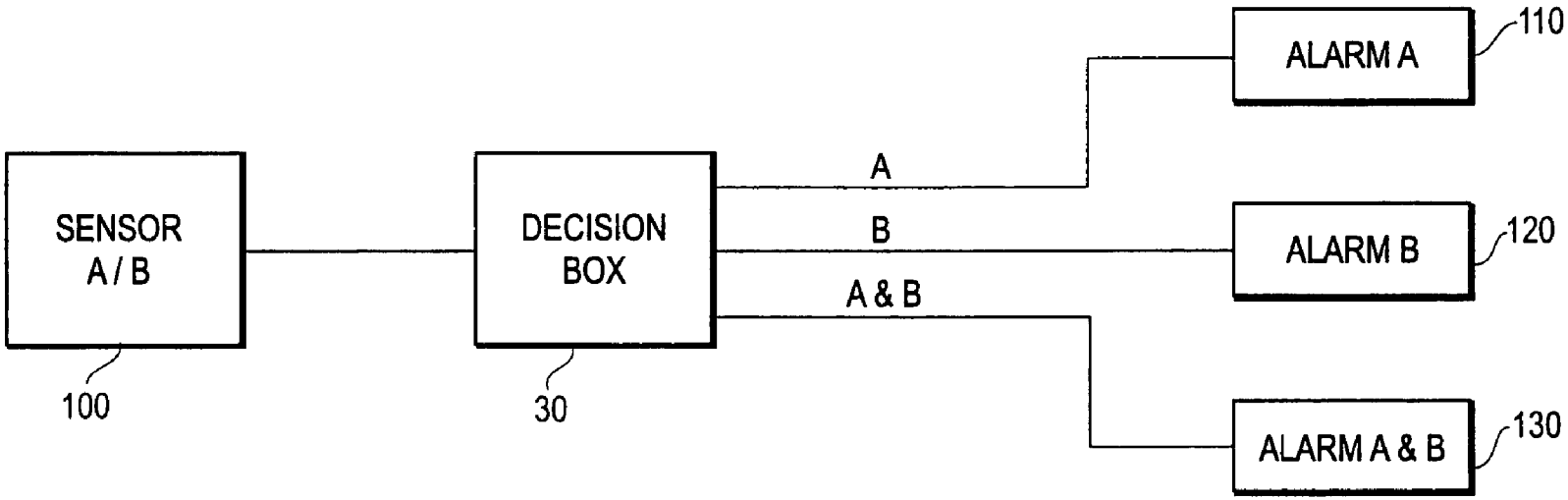
FIG. 2 is a functional diagram of another embodiment of the present combination airborne substance detector apparatus.

FIG. 2 illustrates a functional diagram of another embodiment of the present combination airborne substance detector apparatus. A circuit board 100 can contain a first electronic sensing device and a second electronic sensing device. The first sensing device can detect the presence of a first airborne substance. The second sensing device can detect the presence of a second airborne substance, generally different from the substance being sensed by the first device. The sensing devices electronically communicate with a decision box 30. The decision box 30 continuously and independently communicates with the first and second sensing devices to monitor for input signal fluctuations indicative of a presence of target airborne substances. Additional sensing devices can be contained on, or separate, from the circuit board 100. Furthermore, a single sensing device can be used that can detect multiple target airborne substances and electronically communicate with the decision box 30.

Recordings can be made at predetermined intervals of a quantity of the first and/or second airborne substances detected by the sensing devices. For example, recordings can be made of the resistance, conductivity and/or other relevant electrical parameter(s) and correlated to a concentration level of the target airborne substance.

As with the embodiment discussed in FIG. 1, when an input signal fluctuation is detected from only the first sensing device by the decision box 30, an output signal is sent from the decision box 30 to a first alarming device 110 that produces a first perceivable emission. When an input signal fluctuation is detected from only the second sensing device by the decision box 30, an output signal is sent from the decision box 30 to a second alarming device 120 that produces a second perceivable emission. In the case of a single sensing device, the output signal communication from the sensing device to the decision box 30 determines whether the first or second perceivable emission is triggered by the output signal from the decision box 30. The first and second perceivable emissions are distinct from each other. Typical emissions can include both audible and/or visible warnings.

The sensing devices provide independent detection of airborne substances. The alarming devices provide corresponding independent warnings. Thus, where airborne substances are detected simultaneously or within a short time period of each other, two distinct perceivable emissions will occur from the alarming devices. This distinct alarming can occur from a third alarming device 130 that can include a combination of audible and/or visible perceivable emissions.

The circuit board, sensing devices, decision box, and alarm devices can be contained within an enclosure. Furthermore, the sensing devices, decision box 30, and alarm devices can be contained on the circuit board 100.

Figure 3:
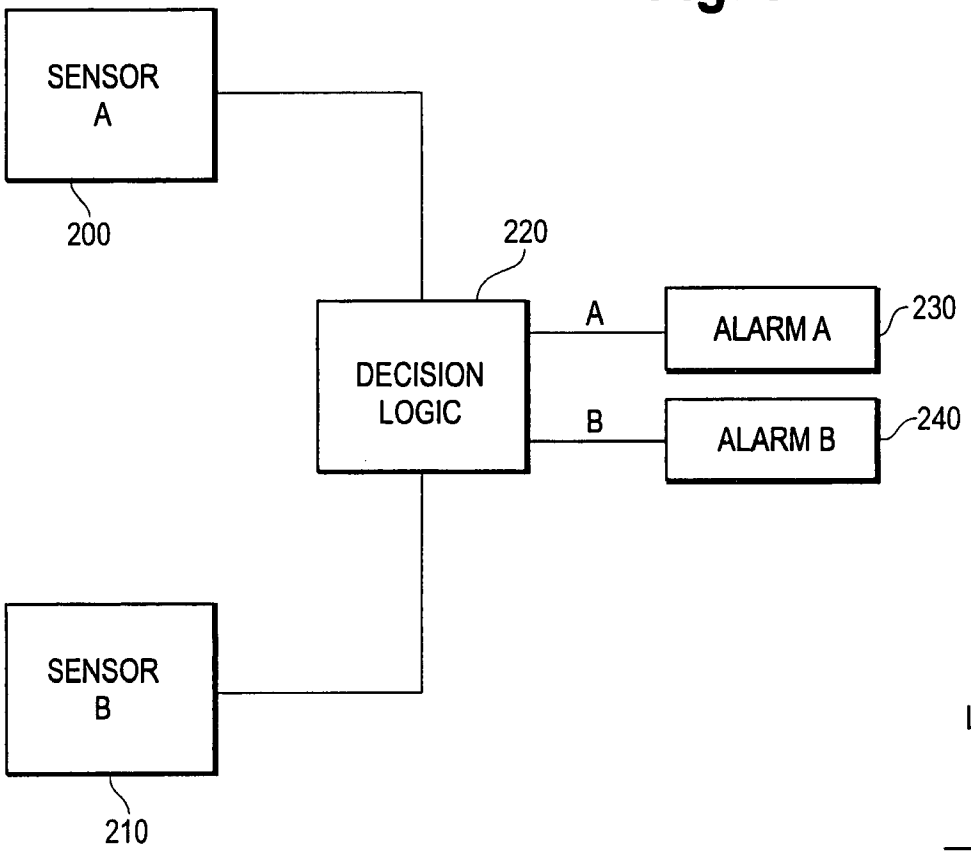
FIG. 3 is a functional diagram of another embodiment of the present combination airborne substance detector apparatus.
Figure 4:
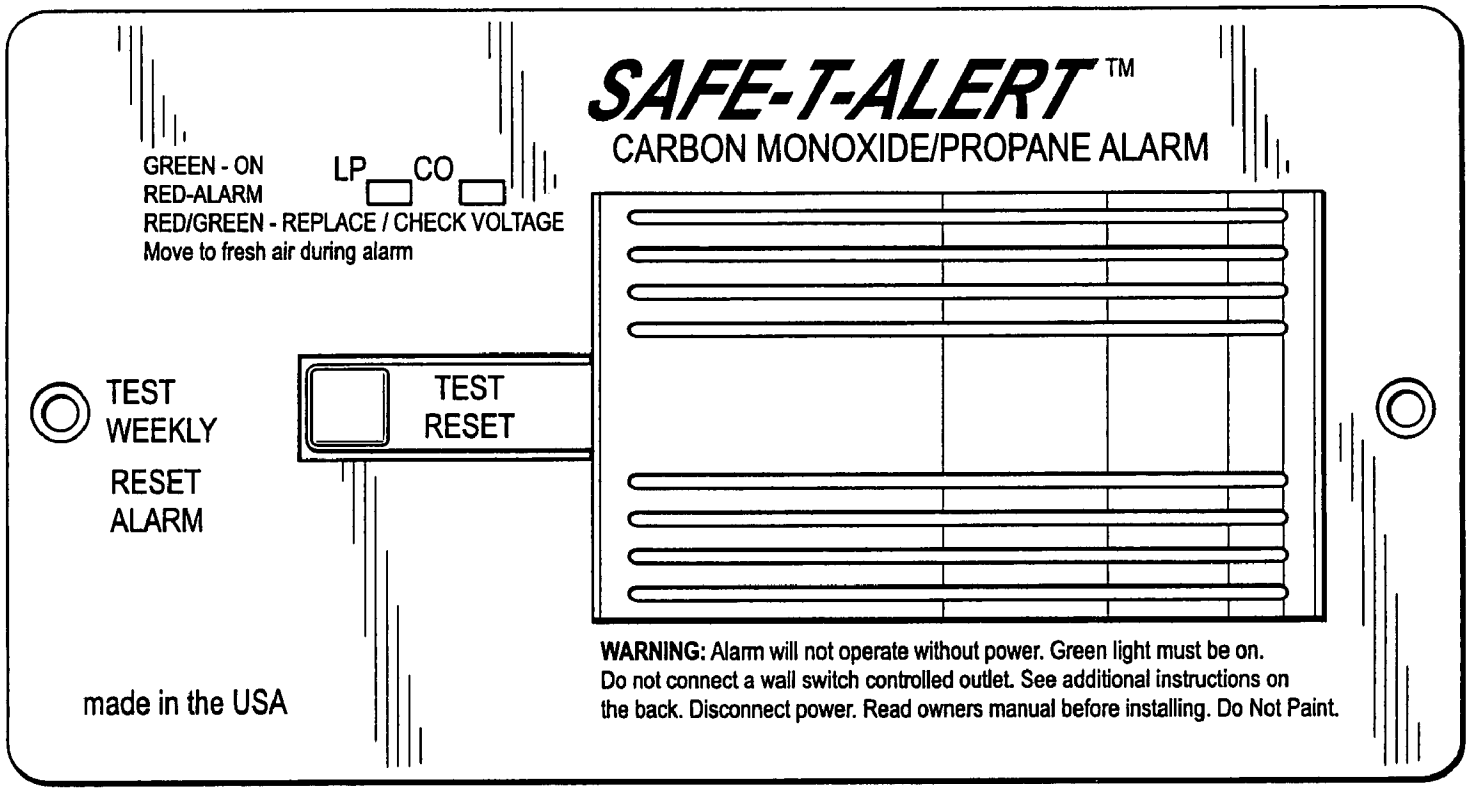
FIG. 4 is a front view of a combination airborne substance detector of the type for carrying out the functions illustrated in one or more of FIGS. 1–3.
Figure 5:
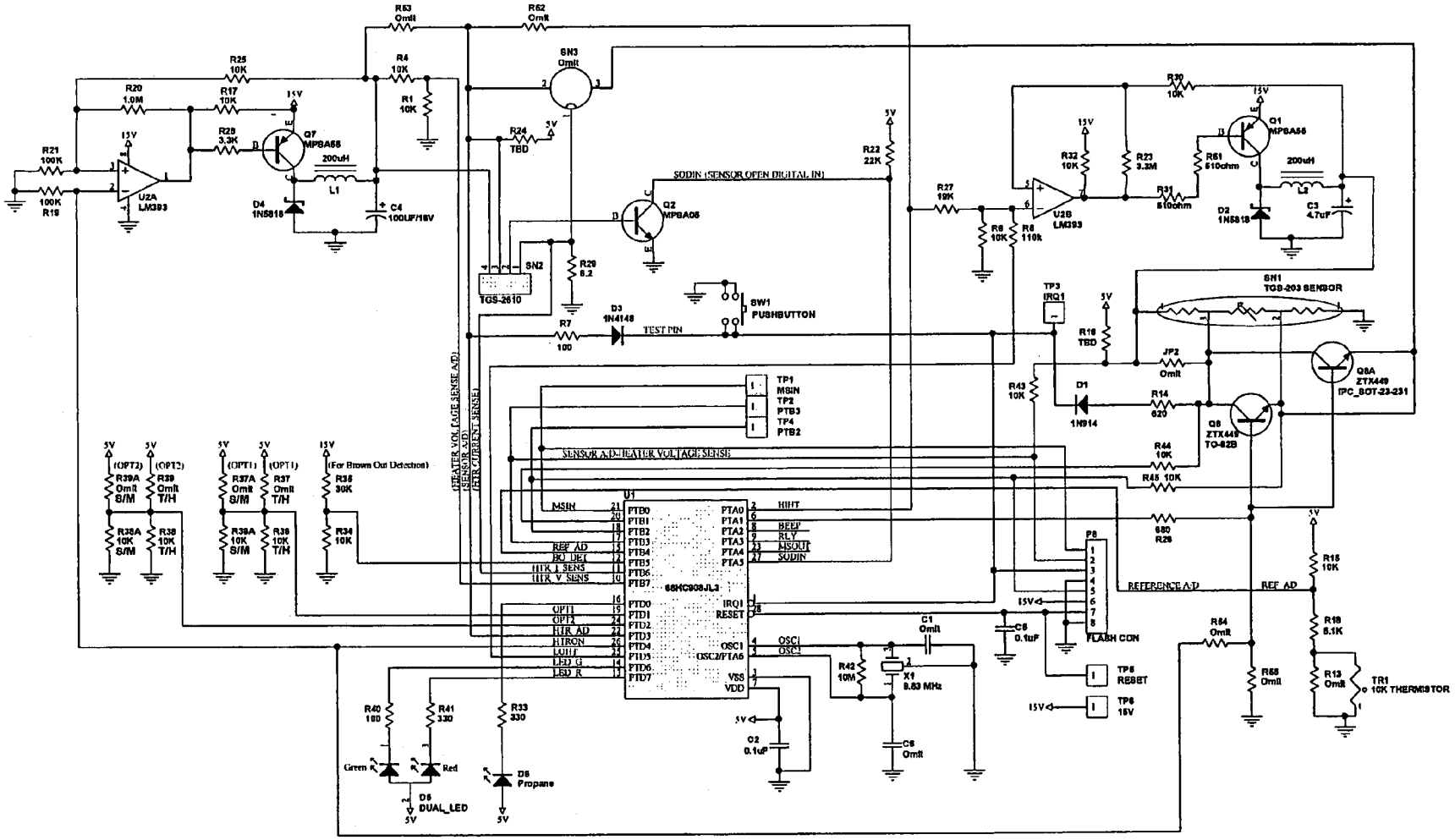
FIG. 5 is a circuit diagram of an embodiment of the electronic components and connections for the airborne substance detector illustrated in FIG. 4.

FIG. 3 illustrates another embodiment of the present combination airborne substance detector apparatus. A first module 200 can be a sensing device for a first airborne substance. A second module 210 can be a sensing device for a second airborne substance, generally different from that being sensed by the first module 200. The first and second modules 200, 210 electronically communicate with a decision logic device 220. The decision logic device 220 continuously and independently communicates with the first and second modules 200, 210 monitoring for input indicative of the presence of airborne substances subject to detection. Additional modules can be connected to the decision logic device 220 to detect additional conditions. Furthermore, the first module 200, second module 210, and additional modules, if any, can constitute a single module that senses multiple airborne substances where the single module electronically communicates with the decision logic device 220.

An output signal (binary code=1) is electronically communicated from the first module 200 to the decision logic device 220 when a target substance is detected by the first module 200. If no output signal (binary code 0) is electronically communicated from the second module 210 to the decision logic device 220, the decision logic device 220 (A=1, B=0) signals a first alarm module 230 producing a first perceivable emission. When a signal fluctuation is detected only from the second module 210 (A=0, B=1), an output signal is sent from the decision logic device 220 to the second alarm module 240 producing a second perceivable emission. When a signal fluctuation is detected from both the first and second modules 200, 210 (A=1, B=1) simultaneously or near simultaneously, an output signal is sent from the decision logic device to both the first and second alarm modules 230, 240 producing distinctive first and second perceivable emissions for each detected airborne substance. In an embodiment of the present airborne substance detector, visible emissions are produced for both the first and second alarm modules 230, 240, with the addition of an audible emission for the more critical airborne substance. In the case of a combination carbon monoxide and propane detector (or other combustible gas), propane is generally the critical substance.

Although the embodiment of the present apparatus described herein is particularly well-suited to the detection of carbon monoxide and propane, persons skilled in the technology involved here will appreciate that the apparatus can also be employed in connection with the detection of smoke, methane, butane, mercury, ethylene oxide, ammonia, volatile organic compounds generally, hydrogen sulfide, hydrogen and other combustible gases generally, chlorofluorocarbons (such as, for example, duPont Freon® chlorofluorocarbons, used primarily as refrigerants), other toxic gases generally, and optically-detectable gases.

While particular elements, embodiments and applications of the present invention have been shown and described, it will be understood, of course, that the invention is not limited thereto since modifications can be made by those skilled in the art without departing from the scope of the present disclosure, particularly in light of the foregoing teachings.

What is claimed is:

1. A combination airborne substance detection apparatus comprising:

(a) an enclosure;

(b) a first module disposed within said enclosure for detecting the presence of a quantity of a primary airborne substance;

(c) a second module disposed within said enclosure for detecting the presence of a quantity of a secondary airborne substance; and (d) an alarm module capable of producing a first perceivable emission when said primary substance is detected and for producing a second perceivable emission when said secondary substance is detected, wherein when said primary and secondary substances are at least one of simultaneously or near simultaneously detected said first perceivable emission is implemented first and includes continuous audio and visual emissions followed by implementation of a non-audio second perceivable emission;

wherein said first and second detector modules are each capable of independently and continuously detecting said primary and secondary substances, respectively.

2. The apparatus of claim 1, wherein the first module and second module constitute a single module capable of sensing a plurality of airborne substances.

3. The apparatus of claim 1, wherein said primary and secondary airborne substances are each selected from the group consisting of smoke, propane, carbon monoxide, methane, butane, mercury, ethylene oxide, volatile organic compounds, hydrogen sulfide, hydrogen, ammonia, combustible gases, chlorofluorocarbons, toxic gases, and optically-detectable gases, and said primary substance and said secondary substance are different group members.

4. The apparatus of claim 1, wherein said primary airborne substance is a combustible gas and said secondary airborne substance is carbon monoxide.

5. The apparatus of claim 1, wherein said quantity of at least one of said primary and secondary airborne substances is recorded at predetermined intervals from at least one of said first and second modules, respectively.

6. A combination airborne substance detection apparatus comprising:

(a) an enclosure having at least one opening;

(b) a circuit board disposed within said enclosure;

(c) a first electronic sensing device connected to said circuit board, said sensing device located near said at least one opening, said sensing device capable of continuously and independently detecting the presence of a quantity of a first airborne substance;

(d) a second electronic sensing device connected to said circuit board, said sensing device located near said at least one opening, said sensing device capable of continuously and independently detecting the presence of a quantity of a second airborne substance; and (e) an alarm module capable of producing a continuous first perceivable audio and visual emission and a second perceivable non-audio emission, when said first substance and said second substance are detected at least one of simultaneously and near simultaneously.

7. The apparatus of claim 6, wherein the first electronic sensing device and the second electronic sensing device constitute a single electronic sensing device capable of sensing a plurality of airborne substances.

8. The apparatus of claim 6, wherein said first airborne substance is a combustible gas and said second airborne is carbon monoxide substance.

9. The apparatus of claim 6, wherein said quantity of at least one of said first and second airborne substances is recorded at predetermined intervals from at least one of said first and second sensing devices, respectively.

10. A method of monitoring concentrations of airborne substances comprising:

(a) continuously detecting the presence of a quantity of a primary airborne substance;

(b) continuously detecting the presence of a quantity of a secondary airborne substance; and (c) implementing a continuous first perceivable audio and visual emission when said primary substance is detected and a second perceivable non-audio emission when said secondary substance is detected;

wherein said first emission is implemented first followed by implementation of said second emission when said primary and secondary substances are at least one of simultaneously and near simultaneously detected.

11. The method of claim 10, wherein said primary and secondary airborne substances are each selected from the group consisting of smoke, propane, carbon monoxide, methane, butane, mercury, ethylene oxide, volatile organic compounds, hydrogen sulfide, hydrogen, ammonia, combustible gases, chiorofluorocarbons, toxic gases, and optically-detectable gases, and said primary substance and said secondary substance are different group members.

12. The apparatus of claim 10, wherein said quantity of at least one of said primary and secondary airborne substances is recorded at predetermined intervals.

* * * * *